US007322309B2

(12) United States Patent
Larochelle et al.

(10) Patent No.: US 7,322,309 B2
(45) Date of Patent: Jan. 29, 2008

(54) INFLATABLE STRUCTURE

(75) Inventors: Luc Larochelle, Fleurimont (CA); Serge Larochelle, Windsor (CA)

(73) Assignee: Nautic & Art Inc., Windsor, Québec (CA)

( * ) Notice: Subject to any disclaimer, the term of this patent is extended or adjusted under 35 U.S.C. 154(b) by 0 days.

(21) Appl. No.: 11/392,838

(22) Filed: Mar. 30, 2006

(65) Prior Publication Data

US 2007/0232163 A1 Oct. 4, 2007

(51) Int. Cl.
*B63B 7/00* (2006.01)

(52) U.S. Cl. ..... 114/345; 441/41

(58) Field of Classification Search ..... 114/345; 441/39, 40, 41, 42

See application file for complete search history.

(56) References Cited

U.S. PATENT DOCUMENTS

| | | | | |
|---|---|---|---|---|
| 1,667,912 | A | | 5/1928 | Vlahon |
| 1,686,366 | A | | 10/1928 | Boyle |
| 2,040,616 | A | | 5/1936 | Mapes |
| 2,391,906 | A | | 2/1946 | Kerny |
| 2,403,436 | A | | 7/1946 | Heigis |
| D151,467 | S | | 10/1948 | Potts et al. |
| 2,908,919 | A | | 10/1959 | Bicknell et al. |
| 3,125,770 | A | * | 3/1964 | Reffell ..... 114/345 |
| 3,359,579 | A | * | 12/1967 | Reffell et al. ..... 114/345 |
| 3,629,875 | A | | 12/1971 | Dow et al. |
| 4,919,067 | A | | 4/1990 | Wenstob et al. |
| 5,113,779 | A | | 5/1992 | Amrein et al. |
| 5,267,363 | A | | 12/1993 | Chaffee |
| 5,282,437 | A | | 2/1994 | Avillez de Basto |
| 5,342,230 | A | | 8/1994 | Louis |
| 6,178,911 | B1 | | 1/2001 | Hemphill et al. |

FOREIGN PATENT DOCUMENTS

| | | |
|---|---|---|
| DE | 881164 | 6/1953 |
| FR | 2377320 | 8/1978 |
| GB | 2208158 | 3/1989 |
| WO | 98/00333 | 1/1998 |

* cited by examiner

*Primary Examiner*—Lars A. Olson
(74) *Attorney, Agent, or Firm*—Bereskin & Parr

(57) ABSTRACT

The present invention relates to an inflatable structure comprising an inflatable frame and a single inflation valve. The inflatable frame has at least two chambers in fluid communication with at least one other chamber through a check valve, whereby the chambers are inflated through the inflation valve.

12 Claims, 3 Drawing Sheets

INFLATABLE STRUCTURE

FIELD OF THE INVENTION

The present invention relates to the field of inflatable structures. More particularly, the invention relates to an inflation system for an inflatable watercraft adapted for rescue operations.

BACKGROUND OF THE INVENTION

Numerous examples of inflatable boats are known in the art. Many of these inflatable boats are formed, for safety reasons, from at least two separate inflatable chambers which typically form the side of the boat.

An example of a collapsible inflatable boat is shown in Design Pat. No. 151,467. In this patent, the boat is formed from three separate inflatable chambers each of which has its own valve member for inflating and deflating the chambers. In such a boat, it is necessary to inflate and/or deflate each chamber separately. This is a tedious process which requires a great deal of time and effort since the chamber must be inflated, the pressure checked, further inflation and/or deflation carried out and the process must be repeated in order to arrive at the appropriate pressure.

U.S. Pat. No. 6,178,911 to Hemphill et al. disclose another inflatable boat having a plurality of inflatable compartments. These compartments are connected with one another by virtue of intercommunicating valves which can be opened to connect all of the compartments or closed, once inflated, to isolate each compartment from the others. Hence, if one of the chambers gets punctured during use, only that particular chamber deflates. Such inflatable boats are typically inflated by opening all of the intercommunicating valves and inflating all of the compartments simultaneously via one valve. However, the disadvantage of this method is that the operator needs to remember to open the valves before inflating and close them afterwards. Otherwise, in case a chamber gets punctured, the whole boat would deflate and sink. Moreover, it takes time to open the valves and then close them, which is not a luxury one can afford when the boat is used during urgent rescue missions. Furthermore, the crew or the person being rescued may easily catch his clothes or limbs on the exposed valves.

DE Pat. No. 881 164 to Meyer discloses an inflatable raft using check valves placed inside the tubes. The raft described in this patent uses two inflation valves rather than just one, which is an inconvenient when a rescue crew needs to inflate the raft in a hurry. Moreover, this raft has no inflatable deck and no openings at water level, therefore not being well adapted for rescue operations where imperiled persons need to be rescued from water level and rescuers need to stand up on the deck.

U.S. Pat. No. 5,888,111 to Walker discloses an inflatable raft adapted for rescue. This raft has two U-shaped inflatable chambers and an inflatable deck. Although adapted for the rescue of imperiled persons, this raft may not be easily and rapidly inflated because it requires that the two chambers plus the deck be inflated separately. This forces the operator to connect its source of compressed air at all three different places, losing precious time in the manipulation.

Accordingly, there is need in the art for an inflatable boat adapted for rescue operations that can be rapidly inflated in case of emergency through the minimum of inflation valves, and which can remain safely operable through the use of many chambers, even when suffering from punctures in demanding environments.

SUMMARY OF THE INVENTION

It is an object of the present invention to provide a watercraft that may be rapidly inflated through one inflation valve.

It is another object of the present invention to provide a watercraft that is adapted for rescue operations in harsh environments by having many separate chambers.

It is yet another object of the present invention to provide a watercraft having many chambers that can all be inflated through the same inflation valve while still retaining a level of isolation from one another in case of puncture through the use of check valves.

In accordance with a broad aspect of the present invention, there is provided an inflatable structure comprising an inflatable frame and at most one inflation valve. The inflatable frame has at least two chambers, each one being in fluid communication with at least one other of them through a check valve. The chambers are inflated through the single inflation valve. Preferably, the inflatable structure further comprises an inflatable supporting surface in fluid communication with at least one chamber. More preferably, a deck check valve is used between the supporting structure and one chamber. Advantageously, the check valves are located inside the inflatable frame. Preferably, each one of the chambers is in fluid communication with at least one adjacent chamber. More preferably, each one of the chambers and the supporting surface has a deflation valve.

In accordance with another broad aspect of the present invention, there is provided an inflatable watercraft comprising an inflatable tube and at most one inflation valve. The inflatable tube has at least two chambers, each one being in fluid communication with at least one other of them through a check valve. The chambers are inflated through the single inflation valve. Preferably, the inflatable watercraft further comprises an inflatable deck in fluid communication with at least one chamber. More preferably, a deck check valve is used between the deck and one chamber. Advantageously, the check valves are located inside the inflatable tube. Preferably, each one of the chambers is in fluid communication with at least one adjacent chamber. More preferably, each one of the chambers and the deck has a deflation valve.

Advantageously, all of the watercraft may be inflated by inflating from only one inflation valve. This greatly diminishes manipulation, further reducing the reaction time of a rescue team. Furthermore, because the check valves are concealed inside the watercraft, it is not possible to break them or to get injured on them. Moreover, because check valves open and close automatically, they do not require an operator to intervene when inflating the watercraft, or when a chamber gets punctured. It is also impossible to forget to close the valves, which could lead to all chambers leaking air in case one of them gets of punctured.

For the purpose of the present invention the term frame is intended to mean an inflatable structure to which other elements are attached.

BRIEF DESCRIPTION OF THE DRAWINGS

A detailed description of examples of implementation of the present invention is provided herein below in which reference is made to the appended drawings, in which.

DETAILED DESCRIPTION OF THE INVENTION

Figure 1:
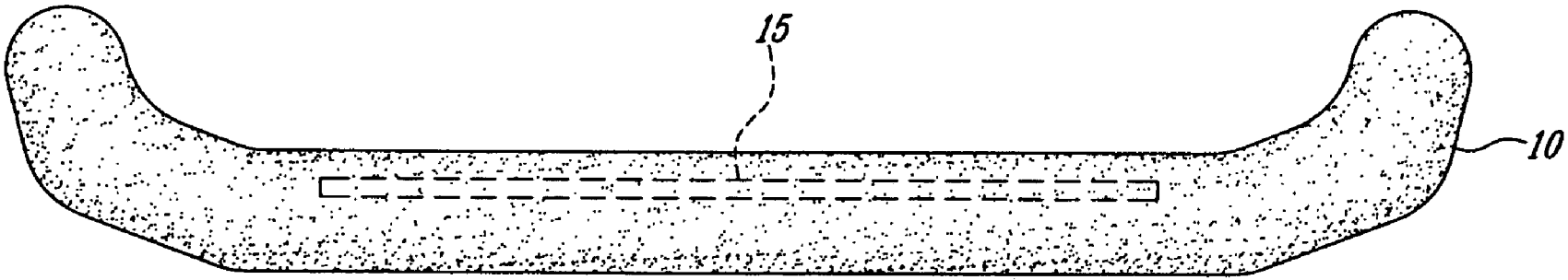
FIG. 1 is a side view of the watercraft in accordance with an embodiment of the present invention.
Figure 2:
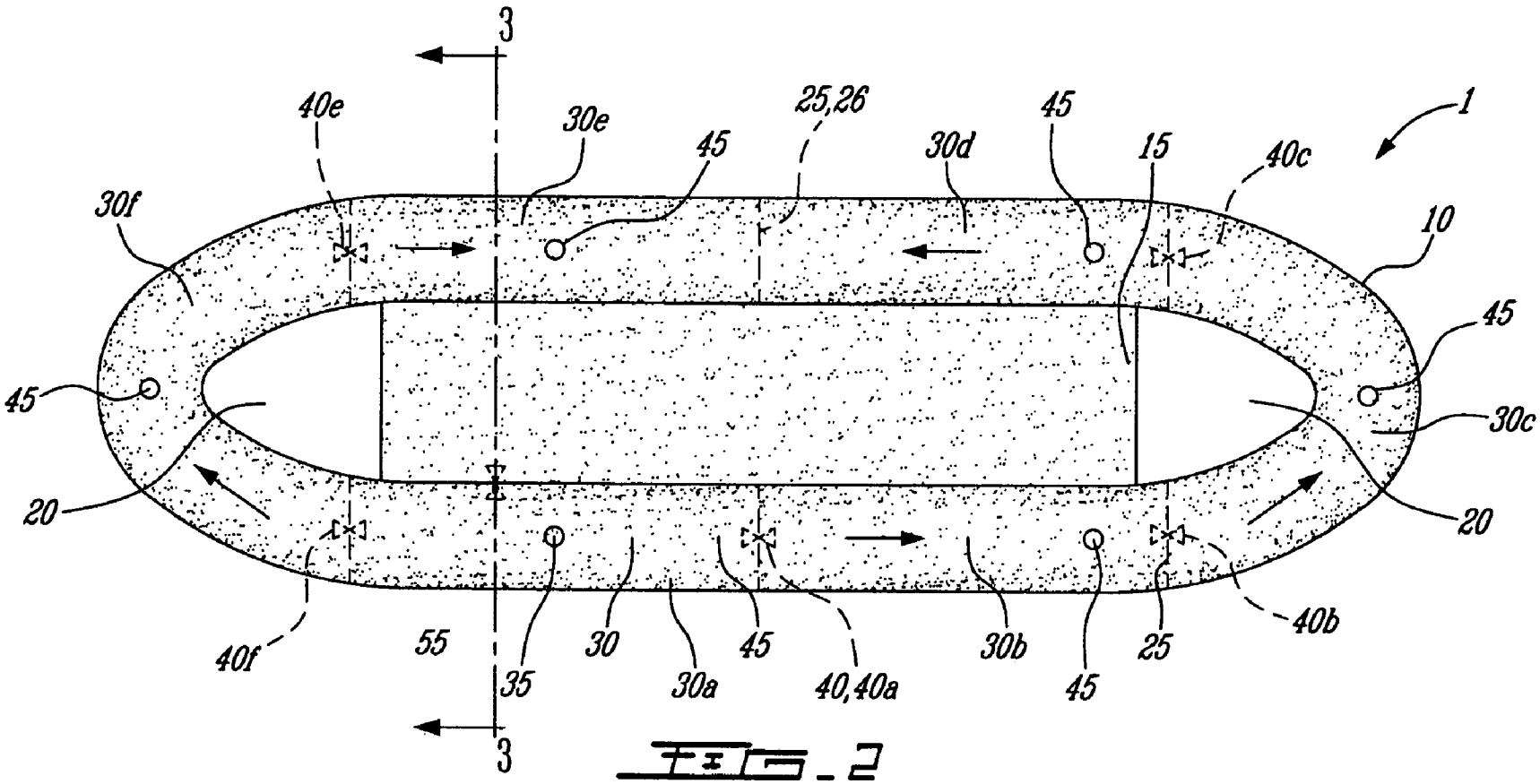
FIG. 2 is a top view of the watercraft of FIG. 1.
Figure 3:
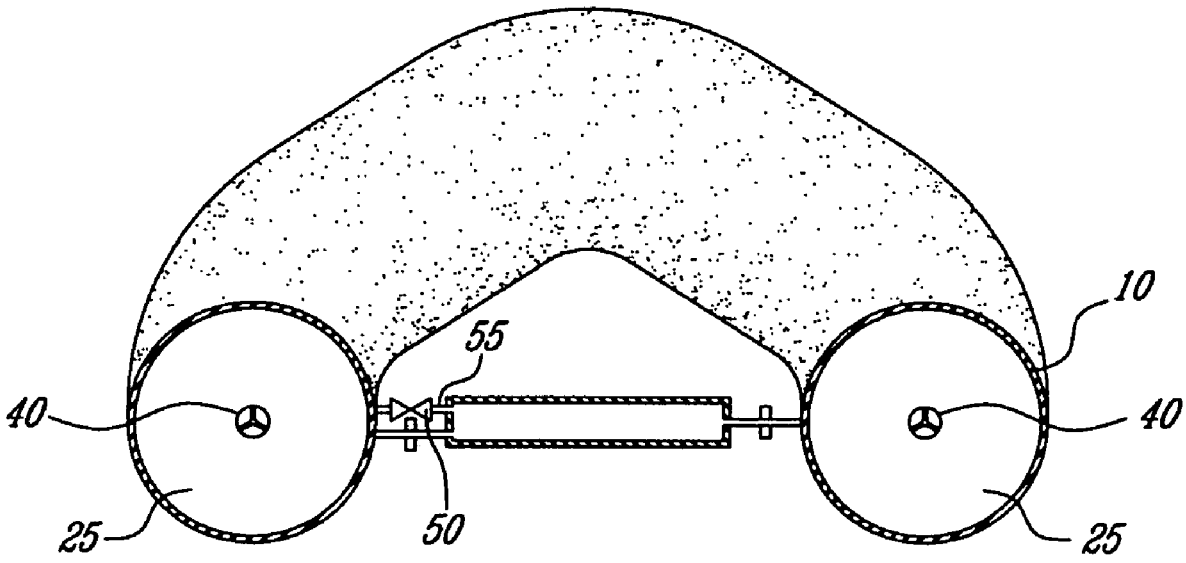
FIG. 3 is a cross-sectional view along lines A-A of a section of the watercraft of FIG. 1.

The present invention will be described with regards to a particular application, namely a rescue raft. FIG. 1 depicts the rescue raft 1 of the invention. The raft comprises an inflatable tube 10, an inflatable deck 15 and two openings 20. The tube 10 encircles the deck 15 and both openings 20. Bulkheads 25 are located inside the tube 10 to divide it in a plurality of chambers 30. A single inflation valve 35 is located at one place on the raft 1, either on the wall of a chamber 30, or on the wall of deck 15. Preferably, it is located in a place where an operator may quickly and easily reach it, such as the top of the wall of a chamber 30 for example. Each chamber 30 and the deck 15 comprise a deflation valve 45.

Check valves 40 are provided to allow the air to communicate from one chamber 30 to another and to the deck 15. The check valves may be located outside of the tube 10, but are preferably located inside the tube 10. Check valves 40 in between chambers are located in the bulkheads 25. In fact, not all bulkheads 25 need to have a check valve 40. Indeed, it is possible to leave one bulkhead 25 without a check valve 40, as long as the air (or any suitable fluid) may circulate in some way to reach each side of chambers 30 and deck 15.

The check valves allow the air to flow from one chamber 30 to another adjacent chamber 30. The raft is typically inflated to 3 psi, but can still be used at somewhat lower or higher pressures. The check valves 40 are set to a lower value than the typical inflation pressure of 3 psi. Typically, the check valves 40 are set to open at 2 psi. Check valves 40 need to be oriented such that air can circulate freely from the inflation valve to all chambers 30 and deck 15. To inflate the raft, a source of compressed air is placed in the inflation valve 35. The first chamber 30*a* gets inflated until it reaches 2 psi. At 2 psi, check valves 40*a* and 40*f* open and air starts flowing to the adjacent chambers 30*b* and 30*f*. Simultaneously, when chamber 30*a* reaches 2 psi, deck check valve 50 opens and air starts flowing into the deck 15. Deck check valve need not necessarily be place in fluid communication with chamber 30*a*. It can be in fluid communication with any other chamber 30. Then, when chambers 30*b* and 30*f* reach 2 psi, check valves 40*b* and 40*e* open to let air flow into chambers 30*c* and 30*e*. Lastly, when chamber 30*c* reaches 2 psi, check valve 40*c* opens and let air flow into chamber 30*d*. When the pressure in all chambers 30 and deck 15 is superior to the opening pressure of the check valves 40, the pressure can be uniformly increased until the desired pressure is attained in the tube 10. Typically, the preferred pressure is 3 psi.

Because the wall of the deck 15 is typically not shared with the wall of the tube 10, a conduit 50, in which a deck check valve 55 is inserted, is used to allow the air to circulate in between a chamber and the deck 15. Once air has reached all chambers 30 and deck 15, it is possible to further increase the pressure in the raft 1 to 3 psi. Since all check valves 40 and the deck check valve 50 are open, the air is free to circulate.

FIG. 1 shows an example of the direction of the check valves 40. If, for example, chamber 30*a* gets punctured, its pressure will drop to 0 psi. As the pressure decreases in chamber 30*a*, the pressure also decreases in all other chambers 30 and deck 15 since all check valves 40 are open. When the pressure gets down to 2 psi, the check valves 40 close and no more air circulates between the chambers 30 and deck 15. Chamber 30*a* is then the only chamber at 0 psi while all others chambers 30 and deck 15 remain at 2 psi. If another chamber, say 30*e* gets punctured, then only this chamber deflates because it is already isolated from other chambers 30 and deck 15. To deflate the raft, all deflation valves 45 must be open.

It is not necessary to use a check valve in bulkhead 26 since air can fill all chambers whether there is a check valve in this bulkhead or not.

Polyurethane, PVC or neoprene may be used for most applications. However, for use in cold weather, the tube 10 and deck 15 are constructed with Hypalon™, which is more resistant to punctures and retains its qualities in such conditions.

The same principle of separate chambers divided by bulkheads having check valves inflated by one inflation valve may be used in any inflatable watercraft. In fact, the same principle may be extended to many other applications such as emergency slides for aircrafts, inflatable furniture, tubes for sliding on snow, etc. In each case, the same principle is used: a frame and a supporting structure are divided into at least two chambers which are in fluid communication through a check valve. Hence, the same principle may be extended to any inflatable structure requiring that, in case of puncture, only one localized area gets deflated while the remaining of the structure retains sufficient pressure for the structure to still be usable.

The person skilled in the art will appreciate that instead of using bulkheads 25, one could also use a plurality of inflatable chambers fitted inside the tube 10. However, designing the tube 10 to be directly inflatable is preferred and more cost effective.

The person skilled in the art will also appreciate that more or less bulkheads 25 with associated check valves 40 may be used in the raft 1. Moreover, the person skilled in the art will appreciate that the tube 10 may take any cross sectional shape and does not need to necessarily take the shape of a round tube. The tube 10 may have any cross-sectional shape that is convenient for the design of the raft 1.

The invention is not limited in its application to the details of the arrangement of components illustrated in the accompanying drawings, or the description of the steps referred to above, but is defined by the claims that follow.

We claim:

1. An inflatable structure comprising an inflatable frame and a single inflation valve, said inflatable frame having at least two chambers, each one of said chambers being in fluid communication with at least one other of said chambers through a check valve, whereby said chambers are inflated through said single inflation valve and wherein said check valves are located inside said inflatable frame.

2. An inflatable structure as defined in claim 1 further comprising an inflatable supporting surface in fluid communication with at least one said chamber.

3. An inflatable structure as defined in claim 2 further comprising a deck check valve between said supporting structure and one said chamber.

4. An inflatable structure as defined in claim 3 wherein each one of said chambers is in fluid communication with at least one adjacent said chamber.

5. An inflatable structure as defined in claim 4 wherein each one of said chambers and said supporting surface has a deflation valve.

6. An inflatable watercraft as defined in claim 5 further comprising an inflatable deck in fluid communication with at least one said chamber.

7. An inflatable watercraft as defined in claim 6 wherein each one of said chambers is in fluid communication with at least one adjacent said chamber.

8. An inflatable watercraft as defined in claim 5 wherein said check valve is located in a bulkhead.

9. An inflatable watercraft as defined in claim 1 wherein said check valve is located in a bulkhead.

10. An inflatable watercraft comprising an inflatable tube and a single inflation valve, said inflatable tube having at least two chambers, each one of said chambers being in fluid communication with at least one other of said chamber through a check valve, whereby said at least two chambers are inflated through said single inflation valve and wherein said check valves are located inside said inflatable tube.

11. An inflatable watercraft as defined in claim 10 further comprising a deck check valve between said deck and one said chamber.

12. An inflatable watercraft as defined in claim 11 wherein each one of said chambers and said deck has a deflation valve.

* * * * *